US005826741A

United States Patent [19]

Dumler et al.

[11] Patent Number: 5,826,741

[45] Date of Patent: Oct. 27, 1998

[54] RESERVOIR HAVING A SCREW CAP FOR NAIL ENAMEL, MASCARA OR THE LIKE

[75] Inventors: Norbert Dumler, Ansbach; Günter Bachmann, Neuendettelsau, both of Germany

[73] Assignee: Georg Karl Geka-Brush GmbH, Bechhofen Waizendorf, Germany

[21] Appl. No.: 682,700

[22] PCT Filed: Jan. 19, 1995

[86] PCT No.: PCT/EP95/00182

§ 371 Date: Jul. 26, 1996

§ 102(e) Date: Jul. 26, 1996

[87] PCT Pub. No.: WO95/20528

PCT Pub. Date: Aug. 3, 1995

[30] Foreign Application Priority Data

Jan. 27, 1994 [DE] Germany ..... 44 02 227.1

[51] Int. Cl.[6] ..... A45D 29/11; B65D 23/12; B65D 41/04

[52] U.S. Cl. ..... 215/321; 15/167.3; 132/73; 132/313; 132/317; 206/823; 215/330; 215/334; 215/391; 401/129

[58] Field of Search ..... 215/321, 330, 215/329, 331, 337, 217, 218, 216, 222, 228, 390, 391, 43, 44; 220/288, 300, 212, 293, 298, 301, 735, 736, DIG. 26; 206/581, 229, 230, 823; 15/167.3, 106–107; 132/73, 313, 317; 401/128–129, 4

[56] References Cited

U.S. PATENT DOCUMENTS

| | | | |
|---|---|---|---|
| 4,271,974 | 6/1981 | Quinard | 215/331 |
| 4,913,299 | 4/1990 | Petro | 215/330 |
| 5,123,556 | 6/1992 | Goldenberg | 215/330 |
| 5,160,057 | 11/1992 | Fitjer | 215/331 X |
| 5,271,512 | 12/1993 | Ekkert | 215/330 X |
| 5,411,157 | 5/1995 | King et al. | 215/321 X |
| 5,588,546 | 12/1996 | Farside | 215/330 X |

FOREIGN PATENT DOCUMENTS

| | | |
|---|---|---|
| 875 827 | 10/1979 | Belgium . |
| 2 517 635 | 6/1983 | France . |
| 2 567 104 | 1/1986 | France . |
| 2 638 621 | 5/1990 | France . |
| 39 42 000 | 10/1990 | Germany . |
| 7 216 573 | 6/1974 | Netherlands . |
| 91/18799 | 12/1991 | WIPO . |

*Primary Examiner*—Allan N. Shoap
*Assistant Examiner*—Niki M. Kopsidas
*Attorney, Agent, or Firm*—Browdy and Neimark

[57] ABSTRACT

In a reservoir having a screw cap for nail enamel, mascara or the like, with a view to attaining a defined final position in the screwing process and reliable closing that is impermeable to liquids and gas-tight, manufacturing tolerances of the reservoir, as occur in particular with glass reservoirs, being taken into account, it is provided that on the upper side of an annular collar (11) of the reservoir (1), provision is made for at least one projection (12) which extends over a certain angle at circumference (β1, β2) of the collar and which, in cross-section, has a stop inclination, a rounded region of transition toward a plateau region (19) that runs approximately parallel to the base surface, and a stop shoulder (20) that is approximately perpendicular thereto downwards, at least one recess (14) of a contour which approximately corresponds to the projection and which extends over about the same angle at circumference being disposed on the lower edge of the screw cap (4), the lower edge of the screw cap (4) extending upwards toward the region on the stop inclination of the recess (14) by an inclination in the direction of the thread pitch, the angle (Γ) of this inclination being slightly smaller than the thread pitch (α).

6 Claims, 3 Drawing Sheets

RESERVOIR HAVING A SCREW CAP FOR NAIL ENAMEL, MASCARA OR THE LIKE

FIELD OF THE INVENTION

The invention relates to a cosmetic container including a reservoir having a screw cap for nail enamel, mascara or the like, the reservoir consisting of comparatively hard material such as glass, hard plastics or the like, and the screw cap, when closed, being intended to take a precisely defined angular position relative to the reservoir so as to provide for accurate positioning of outer contours, inscriptions or the like, corresponding stops being provided on the screw cap or within the thread portion of the reservoir for such a stop position to be attained.

REVIEW OF RELATED TECHNOLOGY

A typcal reservoir of the type under regard is constituted by a nail enamel bottle of glass having a screw cap of plastics serving to close the bottle. Although the invention is not limited to this kind of application, this is what is dealt with in the following.

Nail enamel bottles of the generic type frequently are of a non-circular cross-section that is continued by the outer contour of the screw cap. This helps in creating attractive designs, and moreover a screw cap of for instance oval cross-section can be handled more easily owing to more favourable leverage. For the entire unit to offer an attractive appearance once it is filled and whenever used, it must be ensured that the contours of the reservoir and closure cap or of the decoration of the reservoir and closure cap, respectively, are in alignment, having an accurate position relative to each other. Frequently, the closure cap of plastics exhibits a point provided by injection-molding which is likewise intended to take a predetermined position. In the case of nail enamel bottles, it is further important that reliable sealing of the closure cap and reservoir is attained so as to prevent any leakage of liquid on the one hand and any escape of volatile gaseous components on the other, such as volatile solvent components. Because of these volatile components and for avoiding any inadvertent toppling over, nail enamal bottles should allow rapid opening and closing, it being desirable to use a thread of a comparatively high pitch. For the tactile and acoustic control of whether the bottle is tightly closed, there is yet another requirement especially for units containing volatile components. During closing, the user is to arrive at a defined final position without having to pay special attention to this, and he is to receive acoustic and tactile acknowledgement of the fact that the closure cap has locked into the closing position.

Solutions that ensure the uniformity of contours when the unit is closed are known for reservoirs of comparatively soft plastics (see DE 39 42 000 A1). However, because of the given resilience of the material used, these prior art solutions cannot be conferred to reservoirs that are for instance made of glass. Producing reservoirs of glass has the additional disadvantage that comparatively high tolerances have to be taken into account because of the specific manufacturing technology.

OBJECTS AND SUMMARY OF THE INVENTION

It is the object of the invention to embody a reservoir that has a closure cap and can be made of comparatively hard material, such as glass, it being possible to compensate for any manufacturing tolerances and nevertheless to use a thread of comparatively coarse pitch permitting rapid opening and closing.

To comply with these per se rival requirements, it is provided according to the invention that at least one projection is disposed on the upper side of an annular collar of the reservoir, extending over a certain angle at circumference of the collar of the reservoir and, in cross-section, having a stop inclination, a rounded region of transition toward a plateau region that runs approximately parallel to the base surface and a stop shoulder that is approximately perpendicular thereto downwards, at least one recess of a contour which approximately corresponds to the projection and which extends over about the same angle at circumference being disposed on the lower edge of the screw cap, the lower edge of the screw cap extending upwards towards the region on the stop inclination of the recess by an inclination in the direction of the thread pitch, the angle of this inclination being slightly smaller than the thread pitch.

Preferably, it is further provided that the angle at circumference, over which the recess extends, is slightly less than that of the projection.

For obtaining a symmetrical structure, it is advantageously provided that at least two recesses offset one relative to the other by 180° are disposed on the screw cap or, respectively, that projections are disposed on the reservoir.

By advantage, the angle at circumference of the projections or the recesses, respectively, is in the range of approximately 45° or a rotation through ⅛th. The thread pitch can be about 3 mm per rotation. The radius of curvature of the rounded transition region of the projections may range from 0.5 mm to 5 mm, preferably being 0.5 mm, and, in the case of the recesses, from 0.6 mm to 6.5 mm, preferably 0.6 mm.

The design according to the invention ensures that in the final position or stop position, when the screw cap is screwed on, the stop shoulders of the recesses located on the lower edge of the screw cap will rest on the stop shoulders, of corresponding perpendicular extension, of the projections on the bottle, this accurately defining a final position. Simultaneously, the rounded transition regions of the respective projection on the bottle and of the respective recess on the screw cap lie one above the other so that by making use of the thread clearance and without any need of elastic yielding of the portions around the projection or recesses, arresting and bracing takes place, which ensures not only the position in rotation of the cap, but also provides for high imperviousness. The inclination of the lower edge of the screw cap between the respective recesses is selected such that during the screwing-on operation, the thread clearance is continuously reduced as far as to the stop position, whereby bracing is attained. Because of this design, the arresting mechanism is comparatively insensitive to tolerances in the dimensioning of the collar on the bottle.

BRIEF DESCRIPTION OF THE DRAWING FIGURES

Further details of the invention will become apparent from the ensuing description of an exemplary embodiment, taken in conjunction with the drawing, in which FIG. 1 is a sectional view through a reservoir with a screw cap in the form of a nail enamel bottle, and FIGS. 2 to 4 are illustrations, on an enlarged scale, of the portion of the annular collar of the bottle and of the lower edge of the screw cap in three successive stages of the closing process.

DETAILED DESCRIPTION OF THE PREFERRED EMBODIMENT

Figure 1:
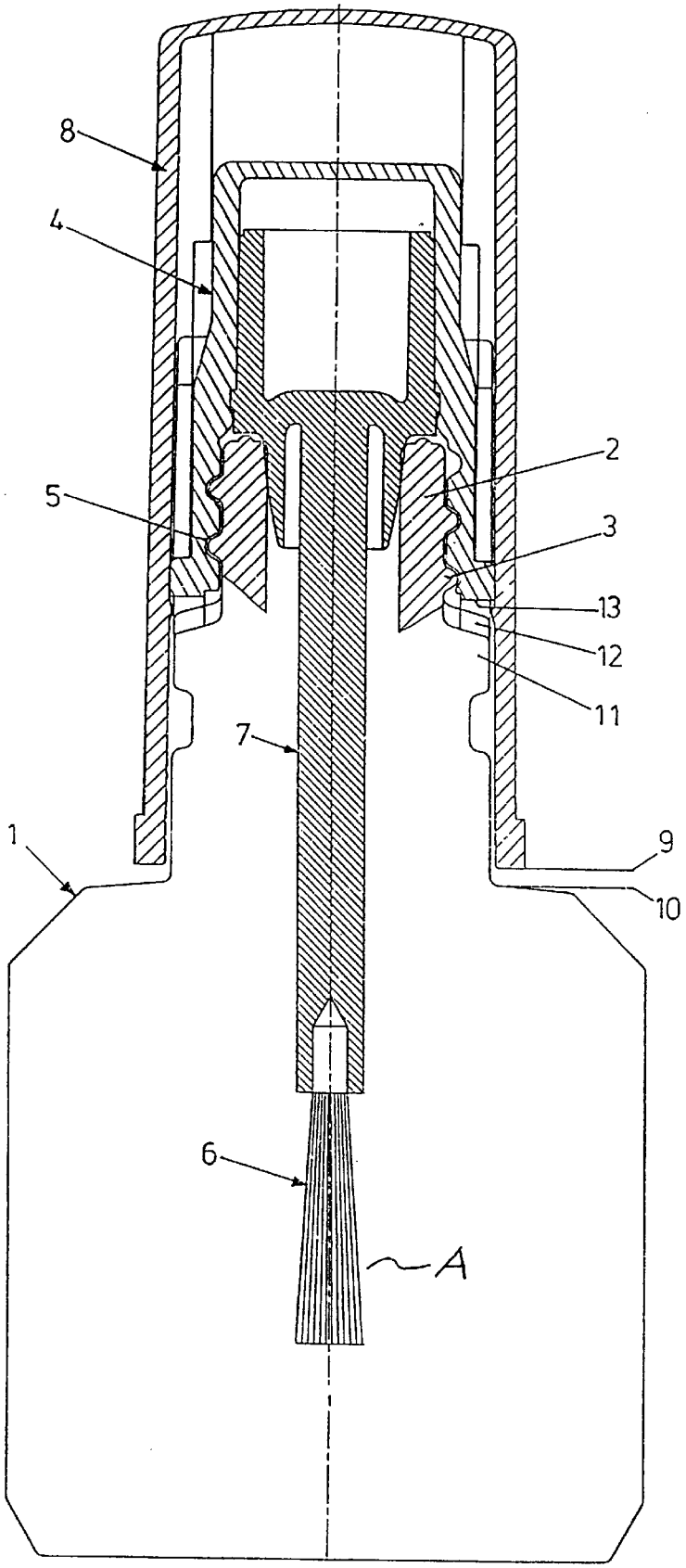

In the nail enamel unit seen in FIG. 1, the reservoir 1 is constituted by a bottle of glass, an external thread 3 of a thread pitch α being formed on the bottle neck 2. The screw helix is concentric about an axis A. A screw cap 4 has a corresponding internal thread 5 and can be screwed on the bottle neck 2. A brush 6 with a plastic mount 7 is disposed inside the screw cap 4. A fancy cap 8 is slipped over the screw cap 4 and is fixed against rotation on the latter, the lower edge 9 of which, in the screwed-on condition, is at a comparatively small distance from an upper shoulder 10 of the reservoir 1. Fundamentally, the external fancy cap 8 may also be made in one piece with the screw cap 4, which is however of no importance in connection with the present application.

An annular collar 11 is formed on the neck 2 of the reservoir 1 or of the bottle, respectively, on the upper side of which projections 12 are molded in positions which are opposite to each other in circumferential angle by 180° around the axis A and which, during the closing and arresting process, cooperate with the lower edge 13 of the screw cap 4 or, respectively, with recesses 14 located there opposite to each other by 180° of circumferential angle. Here, and in the following claims, "pitch" means an inclination angle of the threads and not the spacing between adjacent threads in the direction parallel to the axis A.

Figure 2:
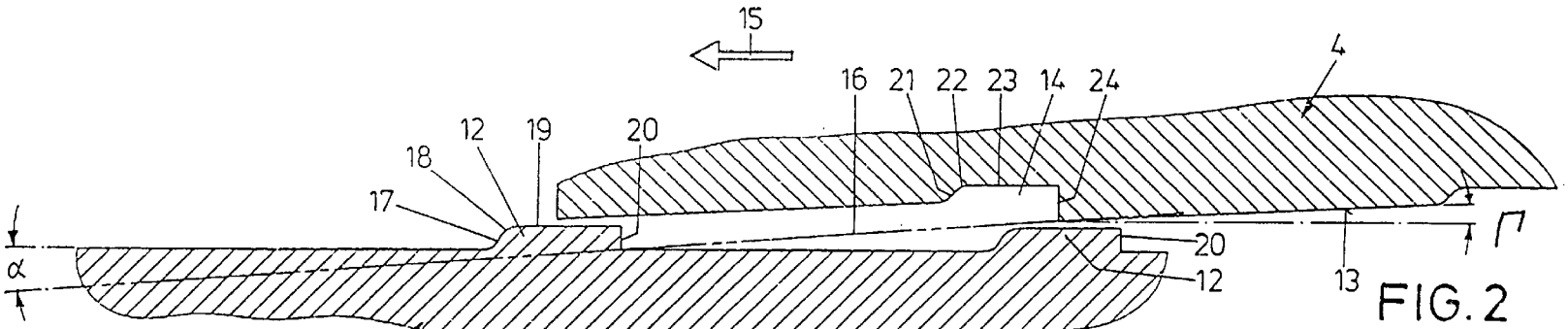
FIGS. 2–4 are cross-sectional views but are not taken on a plane cut; rather they are taken on a cylindrical surface concentric with the axis A shown in FIG. 1. The cylindrical surface has a radius slightly less than the inner radius of the fancy cap 8.
Figure 3:
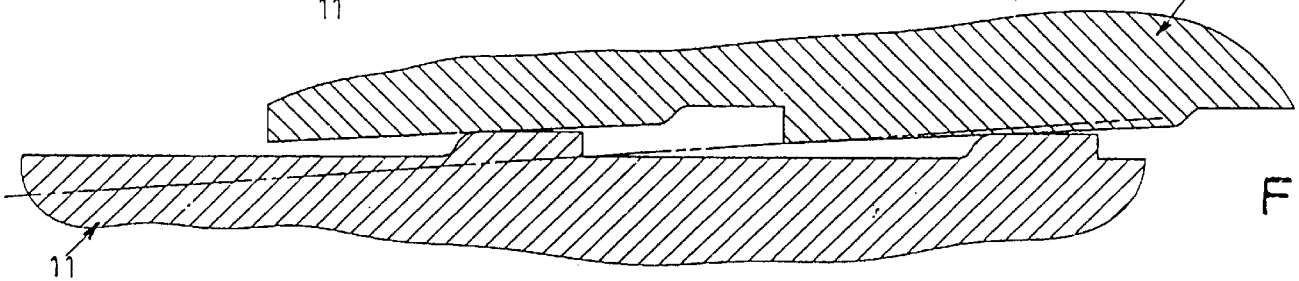
Figure 4:
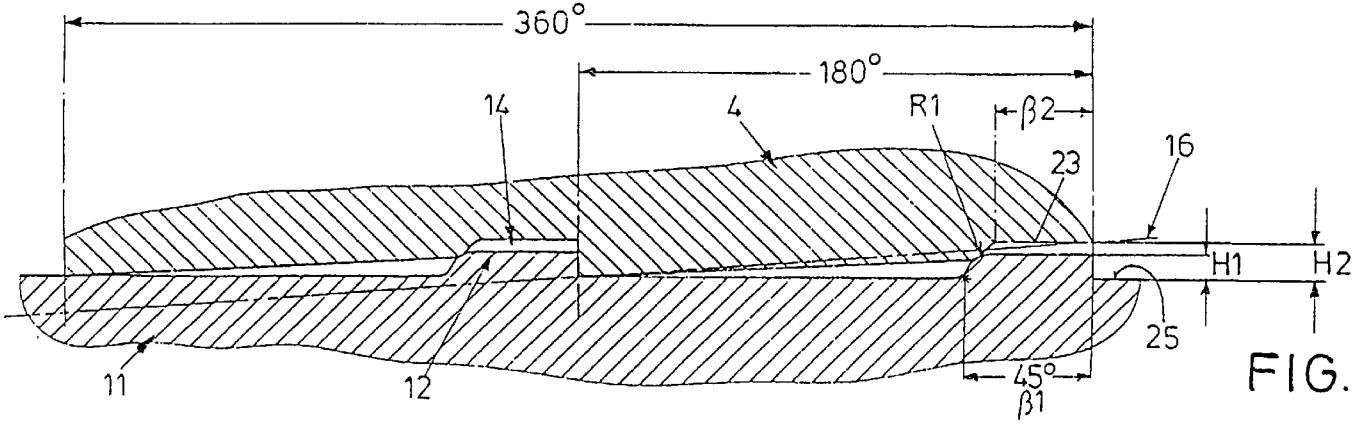
Figure 5:
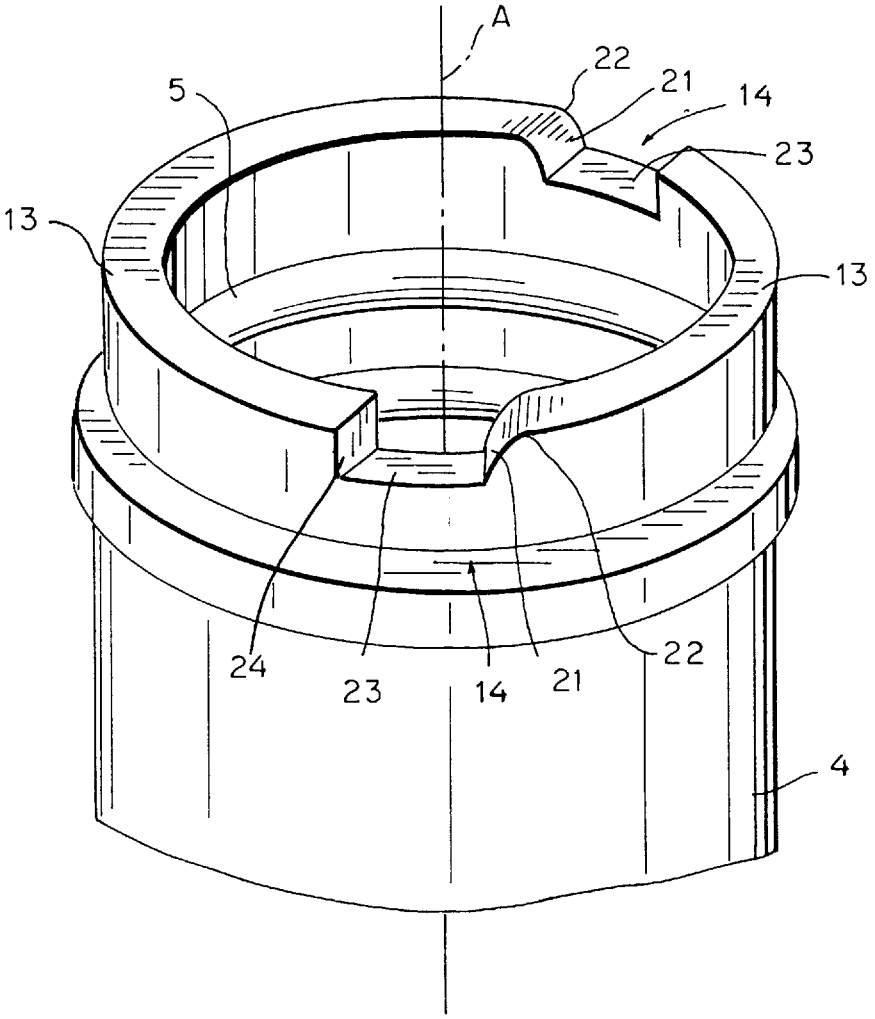
FIG. 5 is a perspective view of the bottom rim of the screw cap.

FIGS. 2 to 4, which are cylindrical cross sections, illustrate various stages of the arresting process, the closure cap 4 being screwed downwards in the direction of the arrow 15 relative to the reservoir 1 or the latter's annular collar 11 along a line 16 in accordance with the pitch α of the thread 3.

As seen in FIGS. 2 to 4, projections 12 are disposed on the upper side of the annular collar 11, each of which comprise an inclined stop shoulder 17, a rounded transition region 18 with a radius of curvature R1 of approximately 0.5 mm, and a plateau region 19 extending parallel to the upper edge of the annular collar 11, as well as a stop shoulder 20 extending vertically downwards therefrom. The stop shoulder 20 is offset by an angle of 180° relative to the stop shoulder 20 of the second projection 12, as seen in particular in FIG. 4.

Each recess 14 exhibits an approximately corresponding cross-sectional configuration, i.e. a stop inclination 21, a rounded transition region 22, a plateau region 23 and a stop shoulder 24.

Each projection 12 extends over an angle at circumference β1 of 45° around the axis A in the exemplary embodiment, whereas the recesses 14 extend over a slightly smaller angle at circumference β2. The lower edge 13 of the screw cap 4 extends towards each recess 14 in an inclined fashion relative to the upper edge 25 of the annular shoulder 11, the angle of inclination Γ—as seen in particular in FIG. 2—being slightly smaller than the angle of inclination α of the thread 3 or 5, respectively.

Proceeding from a position illustrated in FIG. 2, in which the lower edge 13 of the screw cap 14 is not yet in contact with the upper edge 25 of the annular collar 11, upon further motion in the direction of the arrow 15, a position is reached that corresponds to the illustration of FIG. 3, with the lower edge 13 of the screw cap 4 bearing against the transition region 18 of the projections 12 and with symmetric bracing starting because of the difference of inclination of the angles α and Γ accompanied with a reduction of the thread clearance.

Finally, the stop shoulder 24 of the recess 14 will bear against the stop shoulder 20 of the projection 12, the perpendicular arrangement of these shoulders ensuring an accurately defined angular position for the position of closing. The transition regions 18 and 22 lie one above the other, an interspace remaining between the plateau region 23 of the recess 14 and the plateau region 19 of the projection 12, the interspace for instance amounting to half the height H1 of the projection 12, so that in this closed condition, the plateau region 23 will be located at a height H2 relative to the upper edge 25 of the annular shoulder 11. The height H1 can range from 0.5 mm to 5.5 mm.

A screw cap of this design serves to attain a closing torque ranging from 2.5 to 55 Ncm opening torque ranging from 5 to 85 Ncm destruct torque ranging from 20 to 200 Ncm.

We claim:

1. A cosmetic container comprising:

a reservoir (1) and a screw cap (4), the screw cap including an external thread (5) and the reservoir including a mating internal thread (3) on a neck thereof, the internal and external threads being disposed at a thread pitch (α), the neck being disposed at an upper end of the reservoir;

(a) the neck including an annular collar (11) having a base surface and an upper side, the upper side of the annular collar including an upper surface varying in height as a function of circumferential angle;

the upper surface including at least one projection (12) on the upper side which extends over a certain circumferential angle (β1, β2) around the collar, the projection including in cylindrical cross-section a projection contour including a plateau region running approximately parallel to the base surface, wherein a first end of the plateau region includes a projection stop inclination (17) and a rounded region of transition towards the plateau region (19) and wherein a second end of the plateau region includes a projection stop shoulder (20) that is approximately perpendicular to the plateau region;

(b) the screw cap including a lower edge, the lower edge including a lower surface varying in height as a function of circumferential angle;

the lower surface including at least one recess (14) having a recess contour which approximately corresponds to the projection contour and which extends over about the same certain circumferential angle;

the recess including a stop inclination;

the lower edge extending upwards toward the recess stop inclination at an inclination angle (Γ) in a direction of the thread pitch, the inclination angle being slightly smaller than the thread pitch (α).

2. The reservoir according to claim 1, wherein the angle at circumference (β1) over which the recess (14) extends, is slightly less than that (β2) of the projection (12).

3. The reservoir according to claim 1, wherein the thread pitch is about 3.0 mm per rotation.

4. The reservoir according to claim 1, wherein the radius of curvature of the rounded transition region ranges from 0.5 mm to 5 mm.

5. The reservoir according to claim 1, wherein a recess circumferential angle, over which the recess (14) extends, is slightly less than the certain circumferential angle over which the projection (12) extends.

6. The reservoir according to claim 1, wherein two recesses (14) offset one relative to the other by 180° are disposed on the screw cap (4) and respective projections (12) are disposed on the reservoir (1).

* * * * *